United States Patent [19]

Borchert et al.

[11] Patent Number: 4,575,327

[45] Date of Patent: Mar. 11, 1986

[54] ENCLOSURE FOR THE HOT-ISOSTATIC PRESSING OF HIGHLY STRESSED WORKPIECES OF COMPLEX SHAPE FOR TURBOMACHINES

[75] Inventors: Barbara Borchert, Munich; Herbert Schmid, Lauterbach; Werner Hüther, Karlsfeld; Herbert Merz, Munich, all of Fed. Rep. of Germany

[73] Assignee: MTU Motoren-und Turbinen-Union Munchen GmbH, Munich, Fed. Rep. of Germany

[21] Appl. No.: 465,104

[22] Filed: Feb. 9, 1983

[30] Foreign Application Priority Data

Feb. 13, 1982 [DE] Fed. Rep. of Germany ..... 3205158

[51] Int. Cl.[4] ..... B22F 3/14

[52] U.S. Cl. ..... 425/78; 419/49; 425/405 H

[58] Field of Search ..... 425/405 H, 78; 249/135, 249/160, 161, 162, 164; 419/49

[56] References Cited

U.S. PATENT DOCUMENTS

| | | | |
|---|---|---|---|
| 1,770,368 | 7/1930 | Fahlman | 249/162 |
| 3,044,113 | 7/1962 | Gerard et al. | 425/405 H |
| 3,204,917 | 9/1965 | Richards | 249/135 |
| 3,940,268 | 2/1976 | Catlin | 419/49 |
| 4,104,787 | 8/1978 | Jandeska et al. | 228/186 |
| 4,142,888 | 3/1979 | Rozmus | 249/135 |
| 4,243,199 | 1/1981 | Hill | 249/142 |
| 4,436,485 | 3/1984 | Vonnegut | 164/122.1 |

FOREIGN PATENT DOCUMENTS

| | | | |
|---|---|---|---|
| 2349776 | 5/1974 | Fed. Rep. of Germany | 419/49 |

*Primary Examiner*—Jay H. Woo
*Assistant Examiner*—J. Fortenberry
*Attorney, Agent, or Firm*—Roberts, Spiecens & Cohen

[57] ABSTRACT

A mold comprising a core which is open at one end and has the negative contour of the workpiece and a sheet-metal outer container surrounding the core. High dimensional stability of the core, easy removability of the workpiece from the mold and a smoother surface of the workpiece are obtained by isostatic pressing of titanium powder in the spaces in the mold. The core consists, at least at its negative contour surface for the workpiece, of a high-temperature alloy, particularly one having a base of nickel or iron. This and the titanium powder material of the workpiece are neutral in chemical reaction and low in or free of diffusion with respect to each other upon the hot isostatic pressing. The core is in the form of a ring of segments surrounded by a solid holding ring.

12 Claims, 4 Drawing Figures

ENCLOSURE FOR THE HOT-ISOSTATIC PRESSING OF HIGHLY STRESSED WORKPIECES OF COMPLEX SHAPE FOR TURBOMACHINES

FIELD OF THE INVENTION

The present invention relates to an enclosure or mold for the hot-isostatic pressing of highly stressed workpieces of complex shape for turbomachines, the enclosure including a core having an open end and surrounded by a sheet metal outer container, the core having the negative contour of the workpiece. The invention further relates to a method for forming the workpiece in such enclosure.

PRIOR ART

Such apparatus for the formation of a compressor rotor for a turbine having radial vanes is known from West German Pat. No. 30 10 299. In the known apparatus a one-piece ceramic core is used to form the radial vanes. It has been found that while optimum precision of the shape of the workpiece which is to be subjected to hot-isostatic pressing is obtained, nevertheless an intimate bond between the ceramic core and the workpiece frequently can not be avoided whereby separation of the ceramic core and the workpiece is difficult and a rough surface of the workpiece is obtained which does not satisfy the desired requirements. Another disadvantage of the known apparatus is that the ceramic core is generally removable only by destroying the core and thus it cannot be reused.

SUMMARY OF THE INVENTION

An object of the present invention is to provide apparatus of this type in which, in addition to high precision of the shape of the workpiece which is to subjected to hot-isostatic pressing, easy separation of the workpiece from the core is obtained along with a particularly smooth surface of the workpiece and the possibility of re-using the core.

In accordance with the invention, the above and other objects are achieved in that, using an alloy powder having a base of titanium containing about 80 to 90 wt % titanium or pure titanium as the workpiece material, the core consists, at least in the region of its surface, of a high temperature alloy, particularly one having a base of nickel or iron, which is neutral in chemical reaction and/or of low diffusion with respect to the material of the workpiece.

With the apparatus of the invention, the desired objects are completely achieved; that is, not only is a workpiece of smooth surface and maximum stability of shape obtained, but the core can also be easily detached from the workpiece and used again. Another advantage is that the metallic core has less tendency to form cracks as compared to a ceramic core.

In one embodiment of the invention, the core comprises a plurality of parts including a number of segments corresponding to the number of radial vanes of the rotor, the segments collectively forming the negative contour of the vanes, the core further comprising an outer holding ring which engages and surrounds the segments.

By virtue of the formation of the core with a plurality of elements, the invention is further improved since in this way the core can be removed even more easily from the completely formed workpiece after the hot-isostatic pressing. Additionally, the manufacture of the individual parts of the core is also simpler than the manufacture of a one-piece core in which the formation of the cavities for the radial vanes frequently results in a considerable manufacturing expense.

A further feature of the apparatus of the invention is the tapered formation of the segments and of the holding ring to produce a conical shape for the hub of the rotor.

Yet, another feature of the invention is the provision of parting agents such as boron nitride on the adjoining surfaces of the segments and the ring to assure easy removal of the core from the finished workpiece.

The material of the core must be adapted to the material of the workpiece to obtain good results. For this purpose, the core is composed, for example, of Inconel 718 or EPC 10.

Inconel 718 is a chromium alloy which has the following composition, in percent by weight: 50 to 55% nickel, 17 to 21% chromium, 4.75 to 5.5% niobium plus tantalum, 2.8 to 3.3% molybdenum, 0.65 to 1.15% titanium, 0 to 1% cobalt, 0.2 to 0.8% aluminum, 0 to 0.35% silicon, 0 to 0.35% manganese, 0 to 0.3% copper, 0 to 0.08% carbon, 0 to 0.015% phosphorus, 0 to 0.015% sulfur, 0 to 0.006% boron, the balance being iron.

EPC 10 is an iron-nickel alloy which has the following composition, in percent by weight: 45.7 to 52.35% iron, 31 to 34% nickel, 13.5 to 15% cobalt, 1.2 to 2% titanium, 0 to 0.4% copper, 0 to 0.4% manganese, 0 to 0.3% silicon, 0 to 0.2% aluminum and 0 to 0.05% carbon.

Although the composition of the titanium alloy of workpiece is well known to those skilled in the art, it has been found that the following compositions are particularly effective with the specified core material of Inconel 718 and EPC 10:

| | | | | | |
|---|---|---|---|---|---|
| 1. | 90% Ti, | 6% Al, | 4% V | | |
| 2. | 88% Ti, | 6% Al, | 1% Mo, | 5% Zr | |
| 3. | 86% Ti, | 6% Al, | 2% Sn, | 6% V | |
| 4. | 86% Ti, | 6% Al, | 2% Sn, | 4% Zr, | 2% Mo |

BRIEF DESCRIPTION OF THE VIEWS OF THE DRAWING

One embodiment of the apparatus in accordance with the invention will be described hereafter by way of example for the manufacture of the rotor of a radial compressor with reference to the appended drawing in simplified form. In the drawing.

DETAILED DESCRIPTION

Figure 1:
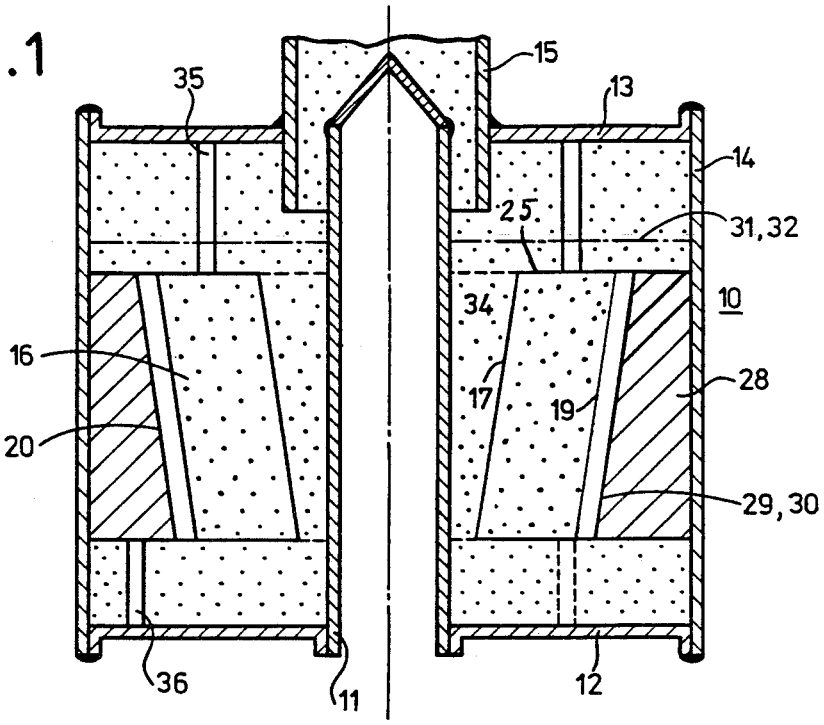
FIG. 1 is a vertical section through the apparatus, the left and right half of the figure representing two different modifications of the invention.
Figure 3:
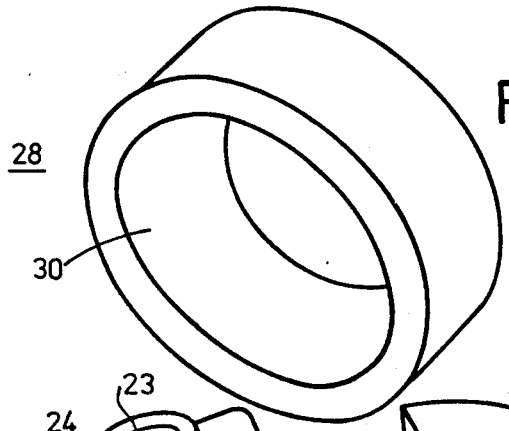
FIG. 3 is a perspective view of a holding ring for the segments as used in the apparatus in FIG. 1 in reduced size.
Figure 2:
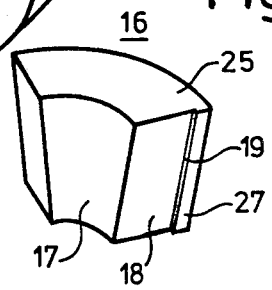
FIG. 2 is a perspective view of a segment as used in the apparatus in FIG. 1, in reduced size.

FIG. 1 of the drawing shows apparatus for the manufacture of a rotor of a radial compressor in the form of a mold including a thin-wall sheet metal container 10 consisting of a cylindrical outer wall 14, a bottom 12, a cover 13 and a coaxial cylindrical tube 11. A lower open end of the tube 11 is seated in an opening in the bottom 12. In a central opening in the cover 13 (which is larger than the opening in the bottom), there is seated a pipe 15 which is spaced circumferentially from the upper closed end of the tube 11 which extends into pipe 15. The pipe 15 serves for introducing a powder 34 of conventional composition consisting of a titanium-base alloy into the container. The elements 11 to 15 are made of steel and are welded together.

The apparatus further comprises a core which was introduced into the container 10 before the welding of the cover 13 to the circumferential wall 14. The core comprises four identical annular segments 16 with inner negative-contour surfaces 17 to 19 and negative contour surfaces 25 at its upper end.

The rotor consists of a one piece body comprising a vane carrier which is a body of revolution in the form of a disk 22, an externally conical hub 24, and four flat radial vanes 21 integral with the hub 24 and the disk 22. The hub 24 has a central cylindrical bore 23. The outside diameter of the tube 11 is slightly smaller than the diameter of the bore 23. The conical negative-contour surfaces 17 of the segments 16 form the surfaces of the hub 24. The planar radial negative-contour surfaces 18 and the negative-contour surfaces 19 of the segments 16 form four slots which define the surfaces of the vanes 21. The negative-contour surfaces 25 at the upper ends of the segments 16 in FIG. 1 form the front surfaces 26 of the disk 22. The segments collectively form a ring, with their surfaces 27 abutting one another to form four slots radially inward thereof for the formation of the rotor vanes 21. The core additionally comprises a dimensionally stable holding ring 28 which engages the segments 26 in surrounding relation to hold them securely in place. The adjacent wall surfaces 29 and 30 of the segments 16 and the holding ring 28 respectively are conical, the larger diameter being at the top in FIG. 1. The upper and the lower end surfaces 25 of the segments 16 and of the holding ring 28 lie in the same planes as seen in FIG. 1.

The core is arranged in the center of the container 10. A vertical spacer 35 is arranged between each segment 16 and the cover 13 and vertical spacers 36 are arranged between the holding ring 28 and the bottom 12. The spacers 35 and 36 are made of steel. The holding ring 28 lies against the circumferential wall 14.

The segments 16 and the holding ring 28 are made of a nickel-chromium alloy such as Inconel 718, or an iron-nickel alloy, such as EPC 10. Inconel 718 and EPC 10 have been described in detail previously, and these alloys have a coefficient of linear thermal expansion which is less than that of the workpiece. Moreover, these alloys are substantially neutral in chemical reaction and of low diffusion with respect to the alloy powder of the rotor. The wall surfaces 29 and 30 are respectively provided with thin slide-promoting coatings 20 such as boron nitride to prevent diffusion bonding and facilitate removal of the core from the workpiece.

Figure 4:
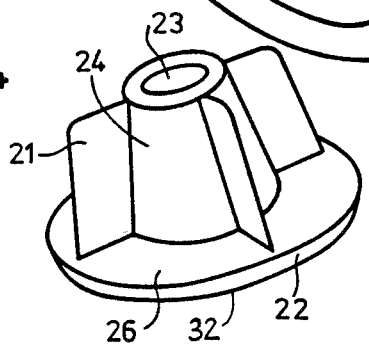
FIG. 4 is a perspective view of the workpiece produced with the apparatus of FIG. 1, in reduced size.

In operation, after the core has been placed in the container 10, and the cover 13 welded to the wall 14, the entire free inner space inthe container 10 together with all cavities in the core is filled completely with the powder 34 after which the pipe 15 is welded closed. In order to achieve hot isostatic pressing, the container 10 is subjected to the pressure of a gas within the range of about 1100 to about 2000 bars, the gas having a temperature of 1000° to 1400° K. The powder 34 is then heated by the gas approximately to this temperature. The gas does not penetrate into the container 10 as the container is pressure-tight. Under the gas pressure, the resilient parts 11 to 15 of the container 10, with the exception of the region adjoining the holding ring 28, are pressed in the direction against the powder 34, as a result of which the powder 34 is compressed. After the completion of the hot isostatic pressing and cooling, the circumferential wall 14 is removed by cutting or by turning on a lathe and the tube 11 is also removed. Finally, the upper part of the enclosure is removed in a lathe down to the transverse plane indicated by the chain-dotted line 31, thus obtaining the end surface 32 (shown facing downward in FIG. 4) of the rotor compressor. The holding ring 28 is now pulled axially from the segments 16 and the segments 16 can be removed individually from the hub 24. The holding ring 28 and segments 16 can now be re-used in a new container 10 for the formation of a further rotor.

While the invention has been described in conjunction with a specific embodiment thereof, it will become apparent to those skilled in the art that numerous modifications and variations of the invention can be made within the scope and spirit of the invention as defined by the appended claims.

Thus, for example, instead of making the annular segments 16 and the holding 28 of the core of the specialized alloys entirely therethroughout, it is also possible within the invention to form the segments 16 and ring 28 in the region of the surfaces thereof of the particular high temperature alloy.

What is claimed is:

1. Apparatus for the hot isostatic pressing of a highly stressed rotor of titanium base for a turbomachine, the rotor having a hub and a plurality of radial vanes extending from the hub, said apparatus comprising a core having surfaces of negative contour for forming corresponding surfaces for the rotor, an outer enclosure surrounding said core to form collectively therewith a space for the formation of the rotor, means for introducing an alloy powder for said rotor into said space, said powder comprising a titanium base containing at least 80 to 90% by weight of titanium, said core being composed, at least in the surface region thereof, of a high temperature alloy having a base of nickel or iron which is neutral in chemical reaction and of low diffusion with respect to said alloy powder of titanium base, said core comprising a plurality of annular segments, in a number corresponding to the number of vanes of the rotor, and collectively forming the surfaces of the radial vanes with the negative contour therefor and an outer holding ring engaging said segments in surrounding relation, said enclosure including outer walls surrounding said core and an inner tube within said core which opens externally of said enclosure and means for subjecting said enclosure to heat and isostatic pressure to effect hot isostatic pressing of the powder to form the rotor, said heat and pressure being applied all around to said powder in said space by application to said walls of the enclosure and within said tube, the presence of said tube leading to the formation of a bore within the hub.

2. Apparatus as claimed in claim 1 wherein said holding ring and said segments have adjoining surfaces of conical shape.

3. Apparatus as claimed in claim 2 wherein said adjoining surfaces include respective coatings to prevent diffusion bonding.

4. Apparatus as claimed in claim 3 wherein said coatings are boron nitride.

5. Apparatus as claimed in claim 1 wherein said alloy of the core is of nickel-chrome or iron-nickel with a coefficient of thermal expansion which is less than that of the material of the workpiece.

6. Apparatus as claimed in claim 1 wherein said core is removable from said workpiece and is reusable, the composition of said core and of said workpiece facilitating the removal of said core and the reuse thereof.

7. Apparatus as claimed in claim 6 wherein said segments and outer holding ring are composed of said alloy having a base of nickel or iron.

8. Apparatus as claimed in claim 1 comprising means for separating said core from the formed rotor, the composition of said core as an alloy of nickel or iron base and said workpiece of titanium base facilitating the separation of said core from the rotor and enabling reused of said core.

9. Apparatus as claimed in claim 8 wherein said segments and outer holding ring are composed of said alloy having a base of nickel or iron.

10. Apparatus as claimed in claim 9 wherein said outer holding ring and said annular segments have conical mating surfaces with boron nitride coatings thereon.

11. Apparatus as claimed in claim 1 wherein said inner tube is fitted within said annular segments and has an open end, the other end of said tube being closed.

12. Apparatus as claimed in claim 11 wherein said walls of said enclosure include upper and lower walls, said inner tube being secured to one of said walls and projecting in spaced relation within said means which introduces alloy powder into said space.

* * * * *